US011781425B2

(12) United States Patent
Frith et al.

(10) Patent No.: US 11,781,425 B2
(45) **Date of Patent: *Oct. 10, 2023**

(54) OSCILLATING DATALINK USEFUL IN DOWNHOLE APPLICATIONS

(71) Applicant: Gordon Technologies LLC, Scott, LA (US)

(72) Inventors: Benjamin G. Frith, Lafayette, LA (US); Terrence G. Frith, Lafayette, LA (US); J. Hunter Simmons, Lafayette, LA (US)

(73) Assignee: Gordon Technologies, LLC, Scott, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/548,435

(22) Filed: Dec. 10, 2021

(65) Prior Publication Data

US 2022/0186611 A1 Jun. 16, 2022

Related U.S. Application Data

(60) Provisional application No. 63/123,987, filed on Dec. 10, 2020.

(51) Int. Cl.
*E21B 47/13* (2012.01)

(52) U.S. Cl.
CPC ..... *E21B 47/13* (2020.05)

(58) Field of Classification Search
CPC ..... E21B 47/13; E21B 17/028; E21B 47/12
See application file for complete search history.

(56) References Cited

U.S. PATENT DOCUMENTS

| | | | | |
|---|---|---|---|---|
| 9,644,434 | B2 | 5/2017 | Frith | |
| 10,294,781 | B2 | 5/2019 | Frith et al. | |
| 2007/0223822 | A1 | 9/2007 | Haugland | |
| 2010/0328096 | A1 | 12/2010 | Tache et al. | |
| 2014/0131098 | A1* | 5/2014 | MacDougall | E21B 17/07 175/7 |
| 2014/0231141 | A1 | 8/2014 | Hay et al. | |

(Continued)

OTHER PUBLICATIONS

Publication (when published) of U.S. Appl. No. 17/495,429, filed Oct. 6, 2021.

(Continued)

*Primary Examiner* — Amine Benlagsir
(74) *Attorney, Agent, or Firm* — Zeman-Mullen & Ford, LLP

(57) ABSTRACT

A datalink tool comprising an MWD-connected assembly disposed to move relative to an LWD-connected assembly. A hardwired electrical connection is provided between the MWD-connected and LWD-connected assemblies. An oil space is provided such that at least part of the hardwired electrical connection is configured to be immersed in a nonconductive oil contained inside the oil space. A compensator sleeve contributes at least in part to isolation of nonconductive oil in the oil space from drilling fluid residing outside the space. In some deployments, the drilling fluid may be conductive. The compensator sleeve is disposed to expand and relax in response to pressure variations in the drilling fluid, thereby attenuating a corresponding effect of the pressure variations in the nonconductive oil inside the oil space.

20 Claims, 10 Drawing Sheets

(56) References Cited

U.S. PATENT DOCUMENTS

| | | | | |
|---|---|---|---|---|
| 2016/0362940 | A1 | 12/2016 | Petrovic et al. | |
| 2018/0100357 | A1* | 4/2018 | Christopher | E21B 17/028 |
| 2018/0230777 | A1* | 8/2018 | Bridges | E21B 47/01 |
| 2018/0306008 | A1* | 10/2018 | Rubio | E21B 47/18 |
| 2018/0347350 | A1* | 12/2018 | Frith | E21B 47/24 |
| 2019/0017373 | A1 | 1/2019 | Anderson et al. | |

OTHER PUBLICATIONS

International Search Report and the Written Opinion of the International Searching Authority issued in related application No. PCT/US2021/062959 dated Feb. 23, 2022 (7 pages).

* cited by examiner

OSCILLATING DATALINK USEFUL IN DOWNHOLE APPLICATIONS

RELATED APPLICATIONS

This application claims the benefit of, and priority to, U.S. Provisional Patent Application Ser. No. 63/123,987 filed Dec. 10, 2020. The disclosure of Ser. No. 63/123,987 is incorporated herein in its entirety.

FIELD OF THE DISCLOSURE

This disclosure is directed generally to subterranean drilling technology, and more specifically to hardwired oscillating datalink technology. In disclosed embodiments, the hardwired oscillating datalink technology allows downhole tools, sensors, etc. at or near a bottom hole assembly (BHA), such as logging-while-drilling (LWD) tools deployed on the drillstring, to communicate robustly with the surface via existing mud pulse telemetry equipment deployed further downhole.

BACKGROUND OF THE DISCLOSED TECHNOLOGY

It is popular and advantageous among current bottom hole assembly (BHA) deployments to mount measurement-while-drilling (MWD) equipment and mud pulse telemetry equipment together at positions comparatively low in the drillstring, (i.e. further downhole, nearer the bit). Typically, such "bottom-mounted" mud pulser deployments mount the MWD sub and mud pulser on (or very near) the universal bottom hole orientation (UBHO) sub, such that the MWD sub is above (i.e. uphole of) the pulser. By contrast, "top-mounted" deployments locate the pulser above the MWD sub.

The MWD equipment's main processing unit (MPU) prefers higher amplitude pulses for data encoding since the higher amplitude pulses tend to carry the encoded MWD data further and more robustly. The MWD MPU has access to higher amplitude pulses when positioned nearby the pulser. However, as drilling fluid (or "mud") flows in an uphole to downhole direction, the flow has a much higher velocity (and is more turbulent) immediately after passing through a flow restriction such as the main orifice on a mud pulser. Locating the MWD sub below the pulser (as in a top-mounted configuration) thus exposes the MWD sub to the high turbulence/velocity flow conditions in the mud immediately downstream of the pulser. The high turbulence/velocity flow conditions may cause or accelerate mechanical erosion of the components in the MWD sub. By contrast, a bottom-mounted deployment nearby the pulser will allow the MWD MPU access to high amplitude pulses without exposing the MWD equipment to such high turbulence/velocity flow conditions in the mud. Bottom-mounted pulsers may also take advantage of shock-dampening equipment such as Gordon Technologies' Shock Miser® tool, embodiments of which interface directly with the UBHO sub. See, for example, U.S. Pat. No. 9,644,434.

Logging-while-drilling (LWD) equipment may be located uphole or downhole of MWD equipment in bottom-mounted MWD/pulser deployments. A data connection ("datalink") between the LWD equipment and the MWD equipment will typically facilitate LWD data communication between the LWD equipment and the surface. The LWD equipment may send LWD data via the datalink to the MWD tool's MPU, which in turn may be configured to encode pulses generated by the mud pulser with LWD data. The LWD equipment is thus given access to the mud pulse telemetry equipment to communicate with the surface. This data communication between LWD tools and mud pulse telemetry equipment is discussed conceptually in ¶0043 of U.S. Published Patent Application 2007/0223822 ("Haugland"). Haugland teaches no specifics, however, as to how such data communication may be enabled.

This disclosure focuses primarily on hardwired datalink technology allowing LWD equipment located uphole of bottom-mounted MWD/pulser equipment to communicate more robustly with the surface. A datalink between bottom-mounted MWD/pulser equipment and LWD equipment further downhole is beyond the scope of this disclosure. Such a datalink between bottom-mounted MWD/pulser equipment and LWD equipment further downhole will typically require the datalink to cross the UBHO sub. Hardwired datalinks such as described in this disclosure are generally unsuitable for crossing the UBHO sub. Instead, see (for example) co-pending U.S. provisional patent application Ser. No. 63/088,309 filed Oct. 6, 2020, entitled "Acoustic datalink useful in downhole applications", for embodiments of an acoustic datalink suitable for crossing the UBHO sub.

As noted, this disclosure focuses primarily on hardwired datalink technology between bottom-mounted MWD/pulser equipment and LWD equipment located further uphole. It is well known to deploy hardwired datalinks between LWD equipment and MWD equipment such as the MWD MPU. Hardwired electrical connections typically provide rotatable connectors at the threaded joints between tools or drillstring sections, and high-pressure feed-through connectors between compartments within tools. The hard wiring calls for insulated wires or cables to extend within the tools between electrical connectors.

Hardwired connections within tools and subs are preferably kept in a nonconductive environment (or else short-circuiting will occur). It will be understood that during normal drilling operations, drilling fluid (or "drilling mud") is continuously circulated at pressure around the BHA, both inside and outside the drill collar. Inside the collar, the drilling fluid flows though pathways designated for the purpose. Such pathways typically include an annular space immediately under the collar. Many drilling fluids are conductive. It is thus important not to contaminate the environments (compartments) surrounding hardwired connections with drilling fluid or else short-circuiting will likely occur.

Conventional deployments deploy the hardwired connections in sealed pathways filled with nonconductive oil. The oil maintains a pressure balance with the drilling fluid inside the drillstring collar. As noted, drilling fluid resides at pressure in drilling fluid pathways inside the drillstring collar. Compartments inside the drillstring collar containing the hardwired connections thus must not only be sealed from contamination from drilling fluid, but need also to be pressure-balanced with the drilling fluid in order to maintain pressure equilibrium within the drillstring. Nonconductive oil deployed within hardwire connection compartments enables the pressure balancing while also providing a nonconductive environment. However, as noted above, it is important not to contaminate the nonconductive oil surrounding hardwired connections with potentially conductive drilling fluid. Leaks between oil compartments and nearby drilling fluid pathways are thus to be avoided. Isolation between oil compartments and drilling fluid pathways is conventionally provided by physical separation (barriers), as well as seals between components such as o-rings and the like.

Unfortunately, relative movement between LWD equipment and MWD equipment during drilling operations stresses the integrity of the isolation between oil compartments and drilling fluid pathways. The LWD equipment is typically designated "fixed" with respect to the drillstring. On the other hand, the MWD/pulser equipment is permitted small amounts of relative movement with respect to the drillstring to accommodate pulsing operations. Further, BHA deployments including Gordon Technologies' Shock Miser® tool intentionally permit additional relative movement between MWD/pulser equipment and the drillstring in order to dampen extraneous environmental concussive forces when generating mud pulses. See, for example, U.S. Pat. No. 9,644,434. The net result is relative movement (or "oscillating movement") between LWD equipment (fixed) and MWD equipment (vibrating) deployed in the BHA. This relative oscillating movement between LWD and MWD equipment causes corresponding pressure oscillation in the drilling fluid that resides inside an LWD-MWD datalink tool. Since the drilling fluid is pressure-balanced with the nonconductive oil also inside the datalink tool, the pressure oscillations tend to transfer from the drilling fluid into the nonconductive oil. Seals around hardwired connections to high-pressure feed through connectors, for example, tend to be static seals. Over time, the pressure oscillations in the nonconductive oil inside the LWD-MWD datalink cause hysteretic fatigue and additional wear on static seals and other barriers separating oil compartments and drilling fluid pathways inside the datalink tool. Eventually these seals and other barriers break down, allowing the drilling fluid to permeate and contaminate the nonconductive oil protecting the hardwired connections in the datalink tool.

There is therefore a need in the art for improved hardwired oscillating datalink technology between LWD equipment and MWD equipment, in which components are provided to dampen pressure oscillations in the nonconductive oil protecting hardwired components within the datalink tool. Ideally, such dampening will remediate hysteretic fatigue and wear on seals and other barriers protecting the integrity of nonconductive oil pathways. This in turn will increase the performance life of hardwired electrical connections within the datalink.

SUMMARY AND TECHNICAL ADVANTAGES

Broadly, the oscillating datalink described herein provides a hardwired electrical connection between LWD equipment and MWD equipment that allows for a range of movement of the MWD equipment while the MWD equipment is operationally connected to a mud pulser. Embodiments of the oscillating datalink technology described herein are suitable to be deployed when the mud pulser includes Gordon Technologies' Shock Miser® tool. See, for example, U.S. Pat. No. 9,644,434.

The needs in the art described above in the "Background" section are addressed by a compensator assembly deployed within embodiments of an oscillating datalink tool described and illustrated in this disclosure. For reference, the disclosed oscillating datalink compensator embodiments borrow ideas from compensator embodiments disclosed in Gordon Technologies' U.S. Pat. No. 10,294,781, in which an oil-filled compensator smooths out pressure fluctuations in a mud pulser servo. It will be nonetheless understood that the oscillating datalink compensator assembly embodiments described in this disclosure solve different problems from the ones solved by compensator embodiments disclosed in the '781 Patent. As such, the oscillating datalink compensator assembly embodiments described in this disclosure should be considered functionally and structurally distinct.

Compensator assembly embodiments described in this disclosure advantageously include a cap-and-sleeve arrangement separating the drilling fluid from the nonconductive oil in the datalink tool. The cap-and-sleeve arrangement is configured to absorb pressure oscillations in the drilling fluid, thereby preventing the oscillations from transferring into the nonconductive oil.

In a first aspect, therefore, this disclosure describes embodiments of a datalink tool, comprising: a first assembly and a second assembly, wherein the second assembly is disposed to move relative to the first assembly; a space; a hardwired electrical connection between the first and second assemblies, such that at least part of the hardwired electrical connection is configured to be immersed in a first fluid contained inside the space; and a compensator sleeve contributing at least in part to isolation of first fluid in the space from a second fluid residing outside the space; wherein the compensator sleeve is disposed to expand and relax in response to pressure variations in the second fluid, thereby attenuating a corresponding effect of the pressure variations in the first fluid inside the space.

Embodiments according to the first aspect may also include a datalink tool deployed inside a drillstring collar.

Embodiments according to the first aspect may also include a datalink tool in which the first assembly is an LWD-connected assembly.

Embodiments according to the first aspect may also include a datalink tool in which the and second assembly is an MWD-connected assembly. Other embodiments may include a datalink tool deployed in a subterranean drillstring including a bit, and in which the MWD-connected assembly is located nearer the bit than the datalink tool.

Embodiments according to the first aspect may also include a datalink tool in which the second fluid is conductive. In embodiments in which the datalink tool is deployed in a subterranean drillstring, the second fluid may be drilling fluid. In other embodiments in which the datalink tool is deployed in a subterranean drillstring, the first fluid may be nonconductive oil. In other embodiments in which the datalink tool is deployed in a subterranean drillstring, the hardwired connection may be deployed not to cross a UBHO sub.

Embodiments according to the first aspect may also include a datalink tool in which the compensating sleeve is made from a material selected from the group consisting of: (a) polymer; and (b) metal.

Embodiments according to the first aspect may also include a datalink tool may further include a movable piston assembly disposed to accommodate relative movement between the first assembly and the second assembly.

It is therefore a technical advantage of the disclosed oscillating LWD-MWD datalink technology to include embodiments of a compensator assembly that absorb pressure oscillations in drilling fluid caused by relative movement between LWD equipment and MWD equipment. Absorbing such pressure oscillations tends to prevent the oscillations from transferring into the nonconductive oil protecting hardwired components in the datalink tool. This in turn tends to reduce the hysteretic fatigue stress and wear caused by pressure oscillations in the oil on seals and other barriers between oil compartments and drilling fluid pathways within the tool. In this way, the compensator assembly embodiments promote the integrity of the datalink's hardwired electrical connections by reducing the chance of potentially conductive drilling fluid leaking into and contaminating the nonconductive oil surrounding the electrical connections.

A further technical advantage of the disclosed oscillating LWD-MWD datalink technology is that preferred embodiments include an anti-rotation assembly between components connected to LWD equipment and components connected to MWD equipment. The anti-rotation assembly embodiments prevent relative longitudinal rotation between LWD-connected and MWD-connected components within the datalink. In this way, the wires within the datalink providing electrical connections across the datalink are prevented from becoming twisted.

A further technical advantage of the disclosed oscillating LWD-MWD datalink technology is that preferred designs optimize the capacity of the oil reservoir and oil pathways to require a minimum volume of oil for the compensator assembly aspect of the datalink to be effectively enabled. Downhole service applications for the datalink are expected to include high temperature environments. High temperatures will dictate corresponding volumetric expansion (thermal growth) of the oil, which thermal growth will have to be taken up by the cap-and-sleeve arrangement in the compensator assembly. High thermal growth of the oil could lead to disadvantageous stresses on the cap-and-sleeve arrangement. Thus, preferred designs optimize the physical volumetric capacity of the oil reservoir and oil pathways so that a minimum volume of oil is required for full datalink operability.

The foregoing has rather broadly outlined some features and technical advantages of the disclosed oscillating datalink technology, in order that the following detailed description may be better understood. Additional features and advantages of the disclosed technology may be described. It should be appreciated by those skilled in the art that the conception and the specific embodiments disclosed may be readily utilized as a basis for modifying or designing other structures for carrying out the same inventive purposes of the disclosed technology, and that these equivalent constructions do not depart from the spirit and scope of the technology as described.

BRIEF DESCRIPTION OF THE DRAWINGS

For a more complete understanding of the embodiments described in this disclosure, and their advantages, reference is made to the following detailed description taken in conjunction with the accompanying drawings, in which.

DETAILED DESCRIPTION

Reference is now made to FIGS. 1 through 5 in describing the currently preferred embodiments of the disclosed oscillating datalink technology, and its related features. FIGS. 1 through 5 should be viewed as a whole for the purposes of the following disclosure. Any part, item, or feature that is identified by part number on one of FIGS. 1 through 5 will have the same part number when illustrated on another of FIGS. 1 through 5. It will be understood that the embodiments as illustrated and described with respect to FIGS. 1 through 5 are exemplary, and the scope of the inventive material set forth in this disclosure is not limited to such illustrated and described embodiments.

Figure 1:
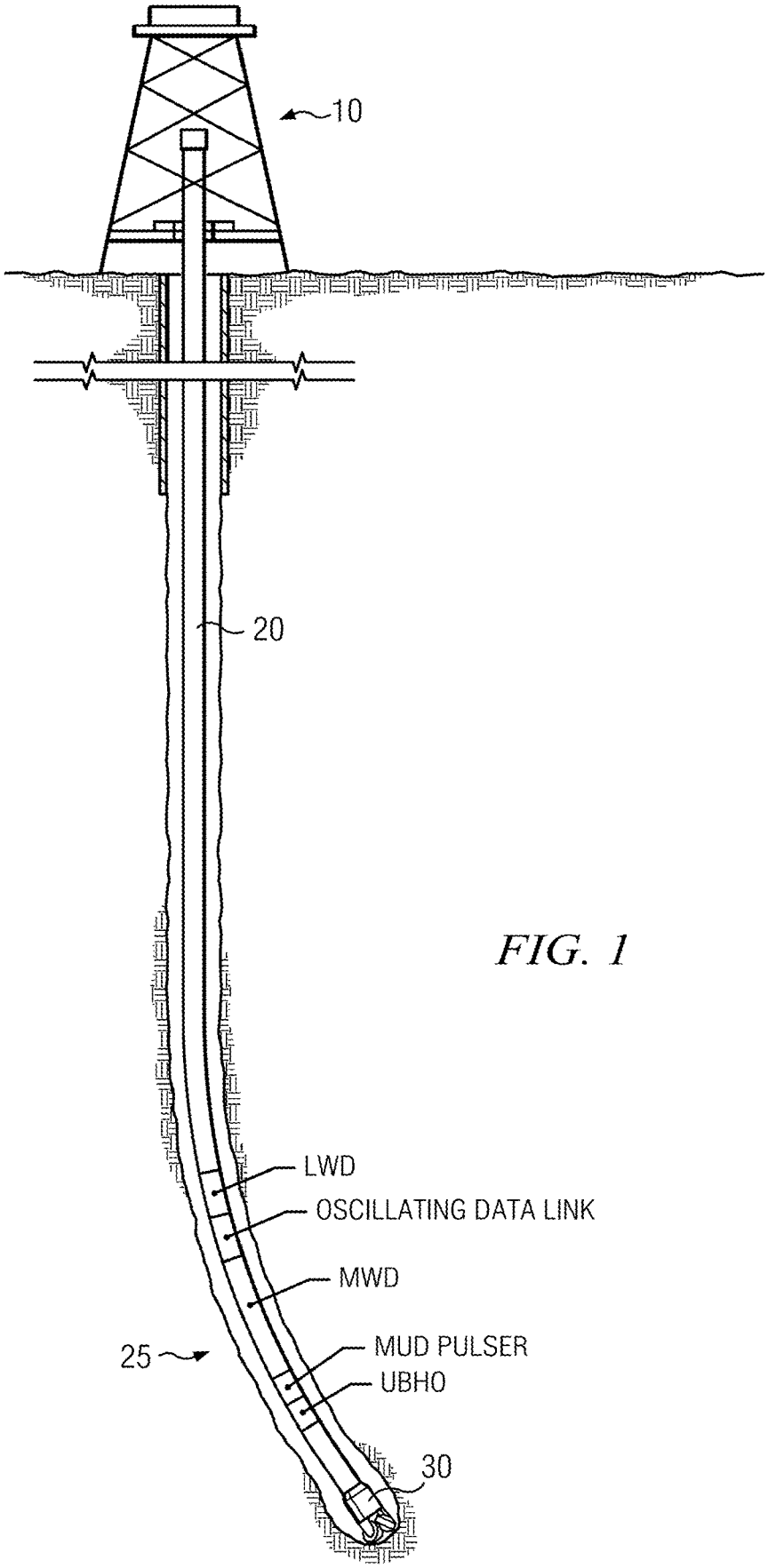
FIG. 1 is a block drawing illustrating schematically a general arrangement of components discussed in this disclosure.

FIG. 1 is a block drawing illustrating schematically a general arrangement of components discussed in this disclosure. FIG. 1 is intended to orient the reader to a typical drillstring arrangement of components illustrated in more detail on FIGS. 2 through 5. FIG. 1 illustrates drilling operations from rig 10, to which bit 30 is connected via drillstring 20. The embodiment of FIG. 1 depicts a deviated wellbore in which bit 30 is driven by a positive displacement motor (PDM), or "mud motor". The scope of this disclosure is not limited, however, to drilling operations involving deviated wellbores or PDM deployments. The embodiment FIG. 1 further illustrates a section of interest 25 in the Bottom Hole Assembly (BHA). FIG. 1 depicts BHA of interest 25 including, in order from uphole to downhole:

- Logging-while-drilling (LWD) tool(s)
- Oscillating datalink
- Measurement-while-drilling (MWD) tool (which will be understood to include main processing unit—MWD MPU)
- Mud Pulser
- Universal Bottom Hole Orientation (UBHO sub)

The foregoing components will be described in more detail below in context of the oscillating datalink technology described herein.

Figure 2:
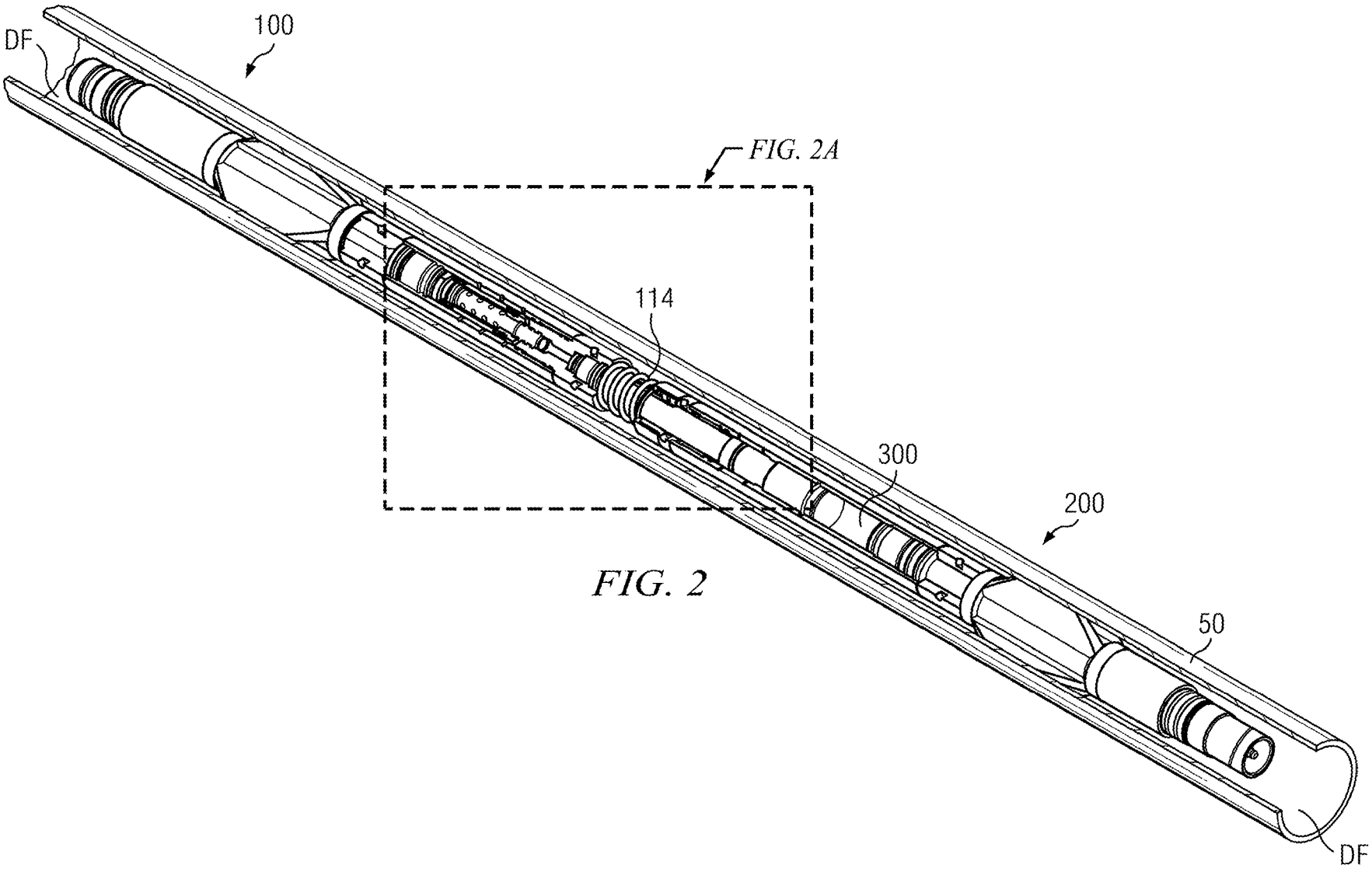
FIG. 2 is a cutaway view of a general arrangement of the disclosed oscillating datalink technology inside drillstring collar 50 in assembled form, including LWD-connected (uphole) assembly 100 and MWD-connected (downhole) assembly 200, in which FIG. 2 also shows a broken-lined box identifying the portions of LWD-connected assembly 100 and MWD-connected assembly 200 corresponding to the enlargements thereof depicted on FIG. 2A.

FIG. 2 is a cutaway view of a general arrangement of an embodiment of the disclosed oscillating datalink technology. FIG. 2 illustrates an interface embodiment between LWD-connected components and MWD-connected components. The datalink tool embodiment illustrated on FIG. 2 is shown inside drillstring collar 50 in assembled form, including LWD-connected (uphole or upper) assembly 100 and MWD-connected (downhole or lower) assembly 200. Other datalink tool embodiments within the scope of this disclosure are not limited to interface embodiments between LWD-connected components and MWD-connected components, and may instead provide interface embodiments between a "first assembly" and a "second assembly". Referring momentarily to U.S. Provisional Patent Application Ser. No. 63/123,987, incorporated herein by reference, Ser. No. 63/123,987 includes a representation of FIG. 2 that is colored to show LWD-connected (uphole or upper) assembly 100 in green and MWD-connected (downhole or lower) assembly 200 in pink. It will be understood with further reference to FIG. 1 that LWD-connected assembly 100 on the embodiment of FIG. 2 is connected, both mechanically and electrically, to LWD equipment further uphole. Likewise, with further reference to FIG. 1, it will be understood that MWD-connected assembly 200 on the embodiment of FIG. 2 is connected, both mechanically and electrically, to MWD equipment further downhole. Mechanical connections may be via conventional threaded pin-and box drillstring connections. The electrical connections through LWD-connected assembly 100 and MWD-connected assembly 200 on the embodiment of FIG. 2 further provide an electrical pathway for data communication between LWD equipment uphole from the datalink and MWD equipment downhole from the datalink.

The color-coded distinction between LWD-connected (upper) and MWD-connected (lower) assemblies 100, 200 in FIG. 2 should be viewed with further reference to disclosure above in the "Background" section. As noted above, the LWD equipment (connected to upper assembly 100 on FIG. 2) is typically designated "fixed" with respect to the drillstring. On the other hand, the MWD/pulser equipment (connected to lower assembly 200 on FIG. 2) is permitted small amounts or relative movement with respect to the drillstring to accommodate pulsing operations. Further. BHA deployments including Gordon Technologies' Shock Miser® tool intentionally permit additional relative movement between MWD/pulser equipment and the drillstring in order to dampen environmental concussive forces when generating mud pulses. The net result is relative movement or "oscillation" between fixed LWD equipment (connected to upper assembly 100 on FIG. 2) and vibrating MWD equipment (connected to lower assembly 200 on FIG. 2) deployed in the BHA.

FIG. 2 further illustrates drilling fluid DF in the annular space under drillstring collar 50. Additional pathways for drilling fluid DF within LWD-connected (upper) assembly 100 and MWD-connected (lower) assembly 200 are described with reference to additional Figures further below.

FIG. 2 further illustrates oil reservoir 300. Oil reservoir 300 and additional pathways for oil within LWD-connected (upper) assembly 100 and MWD-connected (lower) assembly 200 are described with reference to additional Figures further below.

Figure 2A:
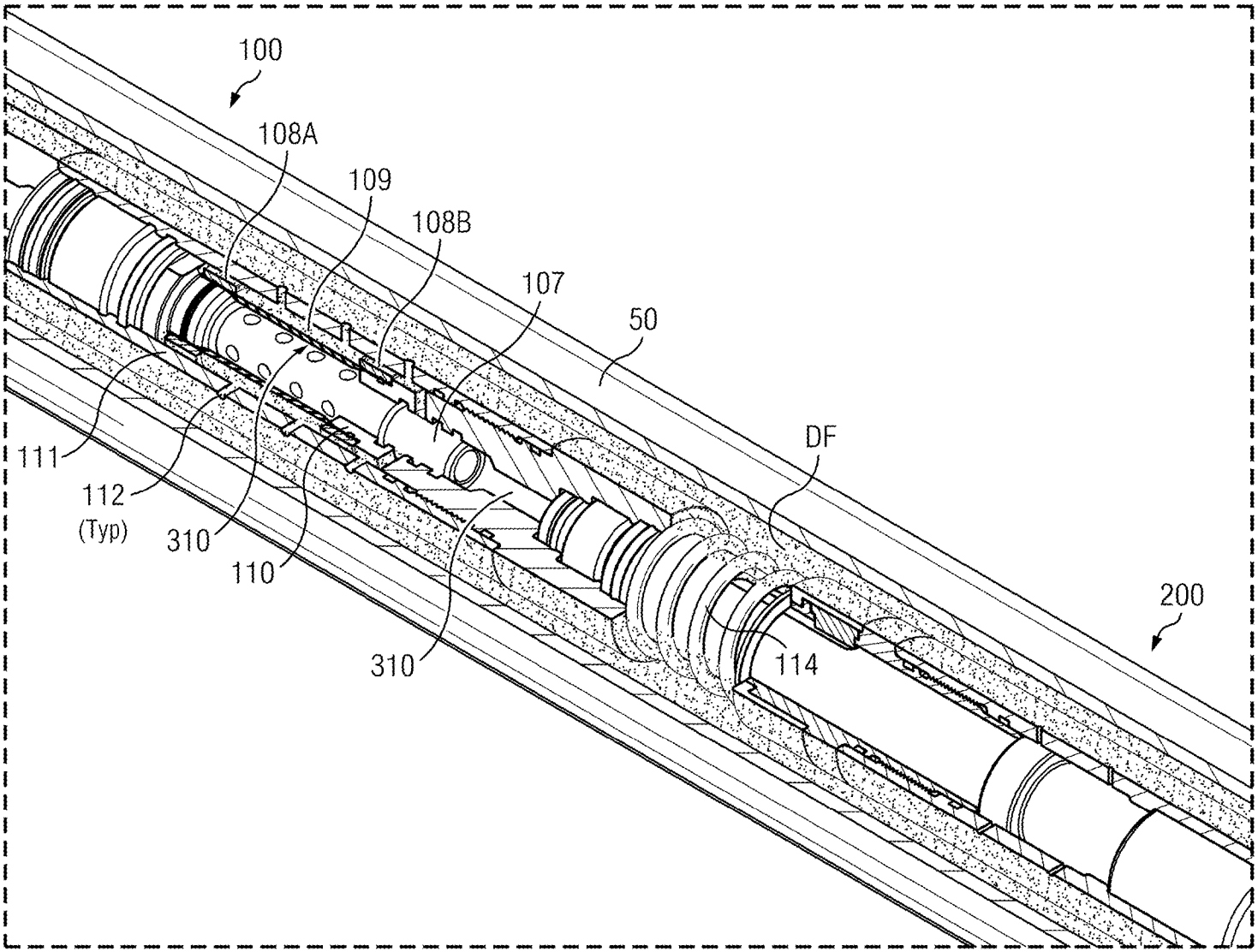
FIG. 2A depicts a broken-lined box containing an enlargement of the portions of LWD-connected assembly 100 and MWD-connected assembly 200 identified in the broken-lined box shown on FIG. 2, in which FIG. 2A further depicts separation between drilling fluid DF and nonconductive oil in oil spaces 310 in the region of compensator sleeve 109.

FIG. 2 further illustrates spring 114. Spring 114 is described in greater detail with reference to additional Figures further below. However, it will be understood generally that in currently preferred embodiments, spring 114 is not part of the embodiments of a compensator assembly within the disclosed datalink technology, where such compensator assembly is configured to absorb pressure oscillations in drilling fluid DF caused by relative movement between LWD-connected (upper) assembly 100 and MWD-connected (lower) assembly 200. FIG. 2A is an enlargement of a region shown on FIG. 2. FIG. 2A depicts separation between drilling fluid DF and nonconductive oil in oil spaces 310 in the region of compensator sleeve 109. Compensator sleeve 109 is part of the compensator assembly embodiments disclosed herein configured to absorb pressure oscillations in drilling fluid DF caused by relative movement between LWD-connected (upper) assembly 100 and MWD-connected (lower) assembly 200. Embodiments of the compensator assembly are described in more detail with reference to FIG. 4A. FIG. 2A, however, shows compensator sleeve 109 keeping drilling fluid DF from contaminating nonconductive oil in oil spaces 310. As is conventional, drilling fluid DF on FIG. 2A resides in the annular space under drillstring collar FIG. 2A further shows that drilling fluid DF is allowed to permeate through drilling fluid holes 112 in upper housing 11 to occupy an annular space between upper housing 111 and compensator sleeve 109. Compensator sleeve 109 retains nonconductive oil in oil space 310 on the other side of compensator sleeve 109, in an annular space between compensator sleeve 109 and compensator tube 107. FIG. 2A illustrates sealing rings 108A, 108B attaching compensator sleeve 109 to compensator tube 107 and compensator cap 110 respectively. In currently preferred embodiments, sealing rings 108A, 108B are crimped to attach, although the scope of this disclosure is not limited in this regard. FIG. 2A shows compensator sleeve 109 and compensator cap 110 thus combining to isolate oil in oil space 310 from drilling fluid DF. Compensator sleeve 109 is preferably made from a polymer material. The polymer material is selected to form a resilient membrane separating oil in oil space 310 and drilling fluid DF. In other embodiments, compensator sleeve 109 may be made from a thin metallic layer or any other material that may form a membrane. As a membrane, compensator sleeve 109 is disposed to expand and relax in response to pressure oscillations encountered in drilling fluid DF, thereby absorbing (attenuating) the corresponding effect of the oscillations in the oil in oil space 310. As a result, the pressure oscillations tend not to be transferred into the oil. Other datalink tool embodiments within the scope of this disclosure are not limited to embodiments keeping drilling fluid DF from contaminating nonconductive oil in oil spaces 310 as shown on FIG. 2A, and may instead provide embodiments keeping a "first fluid" in spaces 310 from being contaminated by incursions of a "second fluid" into spaces 310.

Figure 3:
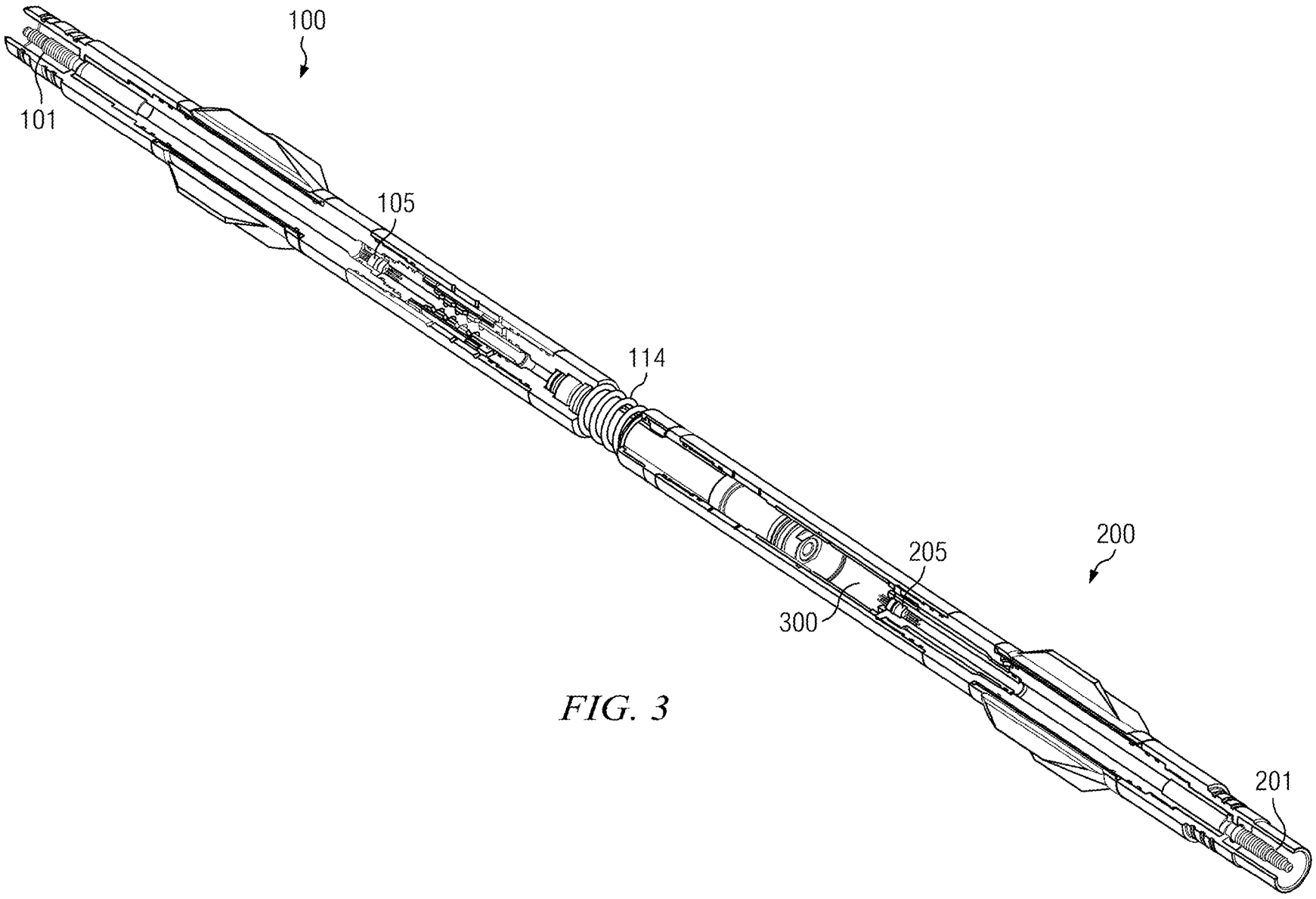
FIG. 3 is cutaway view of a general arrangement of the disclosed oscillating datalink technology described herein, and calls out electrical components whose connectivity during drilling operations the disclosed oscillating datalink technology seeks to sustain.

FIG. 3 is cutaway view ofa general arrangement of the disclosed oscillating datalink technology described herein, and calls out electrical components such as high-pressure feed through connectors 105, 205 and rotatable connectors 101, 201 whose connectivity during drilling operations the disclosed oscillating datalink technology seeks to sustain. FIG. 3 also illustrates oil reservoir 300 and spring 114 for reference to help correlate FIG. 3 with other Figures.

In more detail, FIG. 3 further illustrates generally the physical passageway through which hard wiring may connect high-pressure feed through connectors 105, 205 and rotatable connectors 101, 201. Hard wires are not shown on FIG. 3 for clarity (or on any other Figure in this disclosure for the same reason). Hard wires are conventional and must be imagined. However. FIG. 3 depicts an open passageway (through-bore) along a longitudinal centerline of LWD-connected (upper) assembly 100 and MWD-connected (lower) assembly 200 through which hard wires may extend to connect upper rotatable connector 101 to lower rotatable connector 201 via high-pressure feed through connectors 105 and 205.

Figure 4:
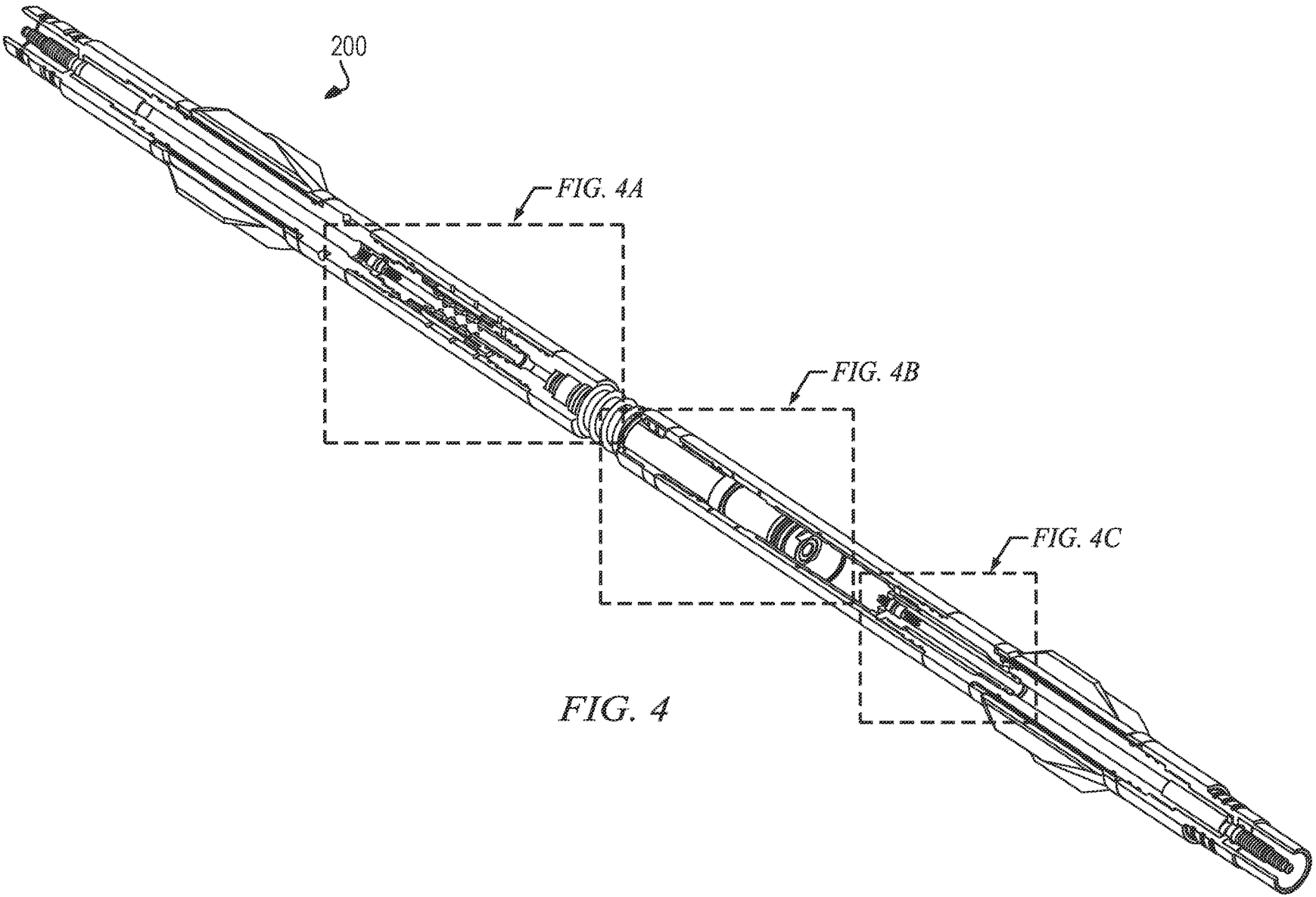
FIG. 4 is the same cutaway view of MWD-connected assembly 200 as shown on FIG. 3, except that the broken-lined boxes depicted on FIG. 4 identify the portions of MWD-connected assembly 200 corresponding to the enlargements of MWD-connected assembly 200 depicted on FIGS. 4A, 4B and 4C.
Figure 4A:
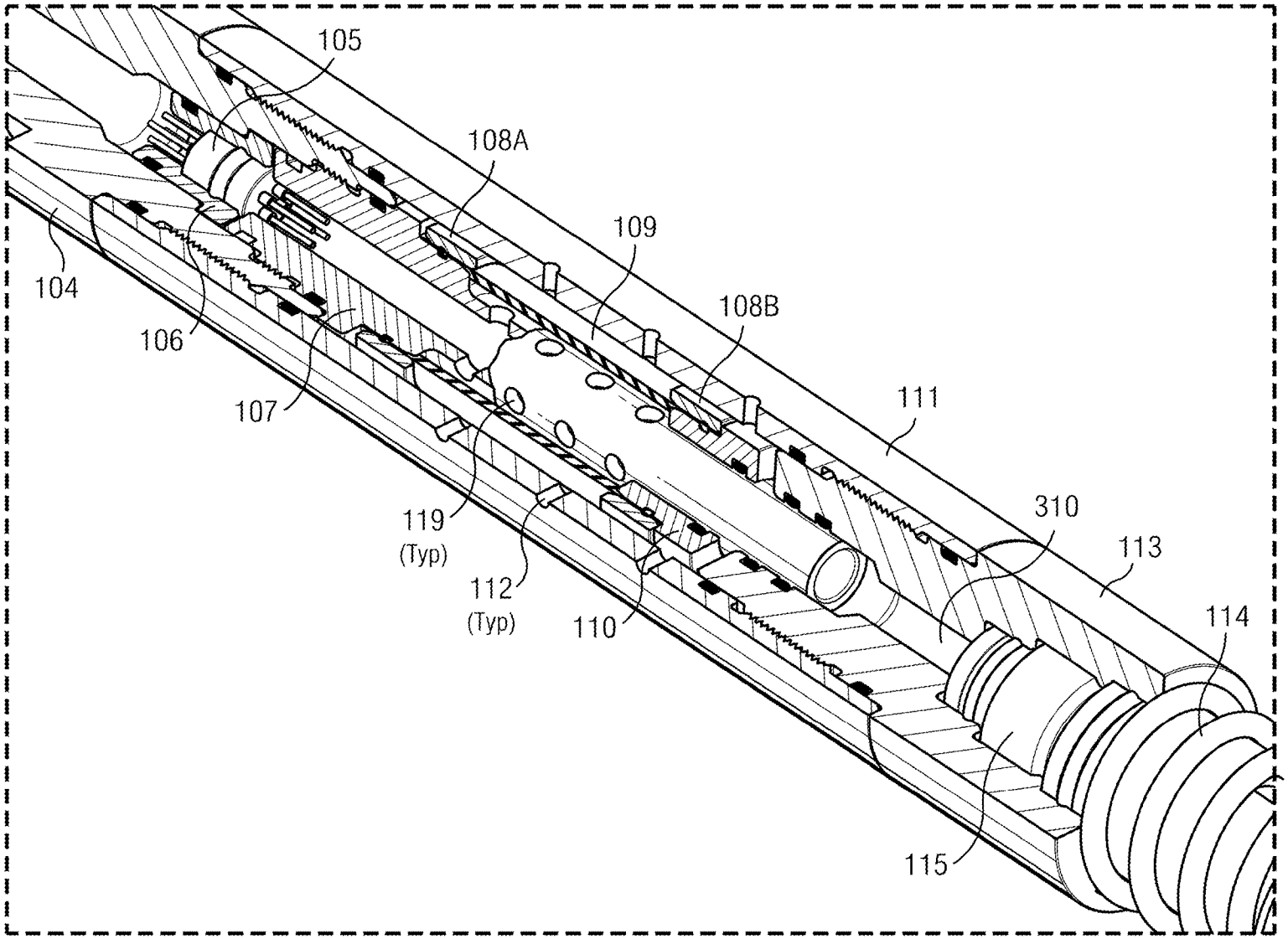
FIGS. 4A, 4B and 4C each depict broken-lined boxes containing enlargements of the portions of MWD-connected assembly 200 identified in the corresponding broken-lined boxes shown on FIG. 4.
Figure 4B:
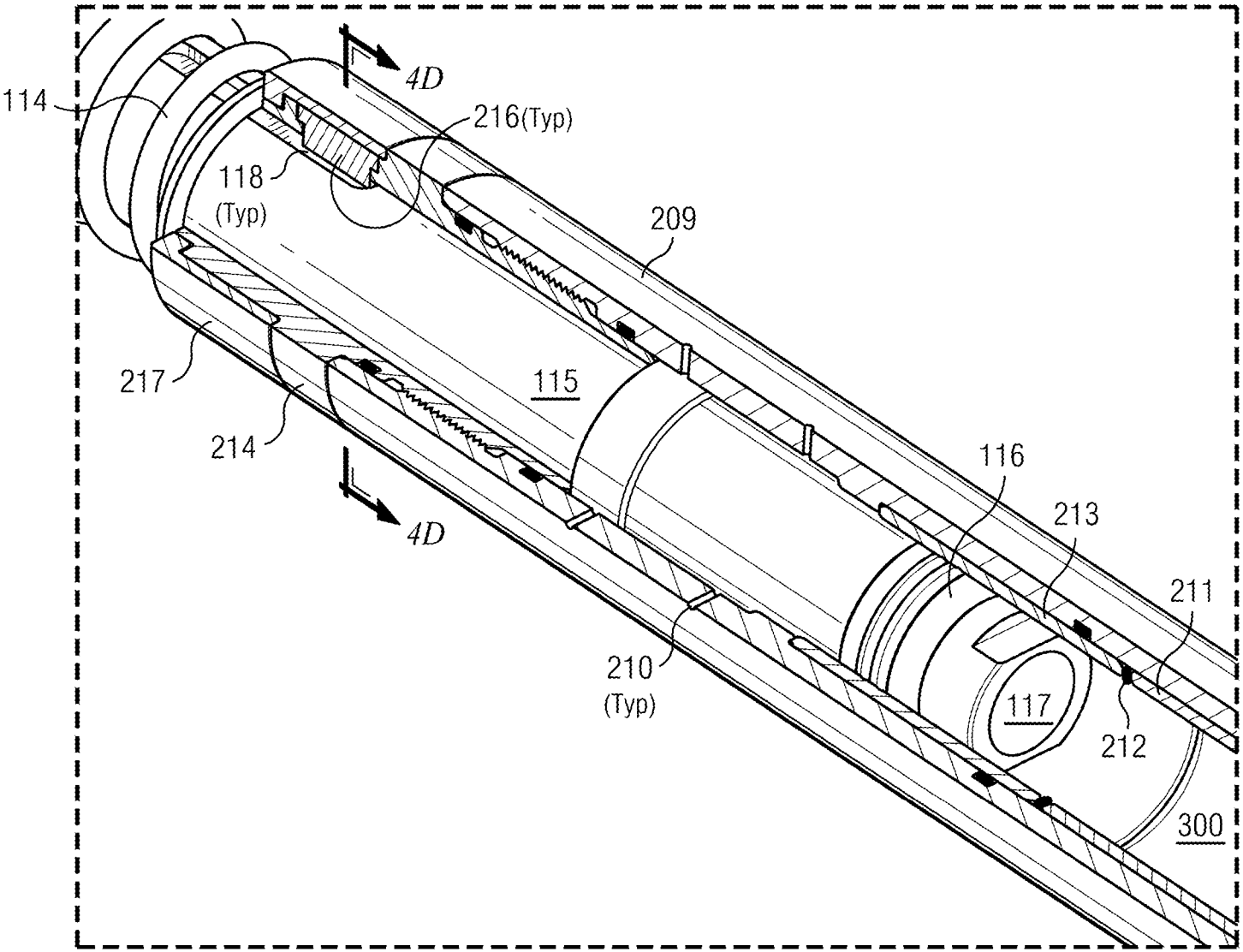
Figure 4C:
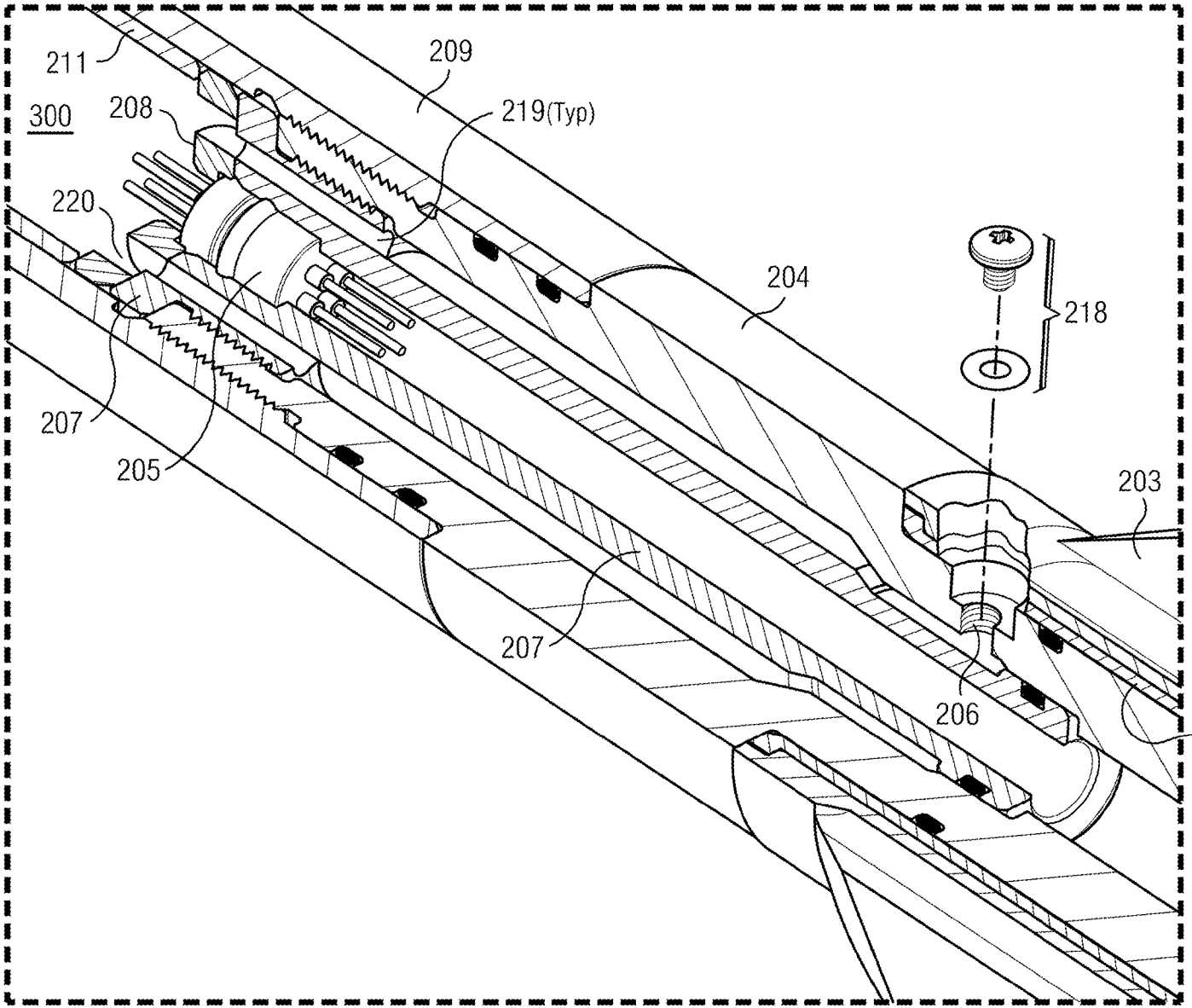

FIG. 4 is the same cutaway view as shown on FIG. 3, except that FIG. 4 illustrates the regions from which enlargements on FIGS. 4A, 4B and 4C are taken. FIG. 4A is an enlargement of a corresponding region shown on FIG. 4. FIG. 4A is a partial section, partial cutaway view of an embodiment of a compensatory assembly, depicting many of the components illustrated on FIG. 2A in more detail. Drillstring collar 50 and drilling fluid DF are shown in FIG. 2A, but are omitted for clarity in FIG. 4A. FIG. 4A shows upper mandrel 104 connected to upper housing 111. With momentary reference also to FIG. 2A, drilling fluid holes 112 in upper housing 111 allow drilling fluid DF to permeate into an annular space between upper housing 111 and compensator sleeve 109. FIG. 4A illustrates feed through mount 106 received into upper mandrel 104, and high-pressure feed through connector 105 received into feed through mount 106. Looking at FIGS. 2A and 4A together, it will be appreciated that high-pressure feed though connector 105 and high-pressure feed through mount 106 form part of a hardwired electrical connection between LWD-connected and MWD-connected assemblies 100, 200 such that at least part of the hardwired electrical connection is configured to be immersed in oil contained inside oil space 310. Compensator tube 107 is shown partially cut away on FIG. 4A. Compensator tube 107 is also received onto upper mandrel 104 to retain feed through mount 106 and high-pressure feed through connector 105. Compensator tube 107 includes oil holes 119 to allow oil in oil space 310 to permeate through into an annular space between compensator tube 107 and compensator sleeve 109.

As also described above with reference to FIG. 2A, FIG. 4A illustrates that compensator sleeve 109 is configured to retain oil in the annular space between compensator sleeve 109 and compensator tube 107. FIG. 4A illustrates sealing rings 108A, 108B attaching compensator sleeve 109 to compensator tube 107 and compensator cap 110 respectively. Sealing rings 108A, 108B preferably attach via crimping, although the scope of this disclosure is not limited in this regard. With further reference also to FIG. 2A, compensator sleeve 109 and compensator cap 110 combine to isolate oil in oil space 310 from drilling fluid DF. More specifically, compensator sleeve 109 contributes at least in part to isolation of oil in oil space 310 from drilling fluid DF residing outside oil space 310. As noted above, compensator sleeve 109 is preferably a resilient membrane separating oil in oil space 310 from drilling fluid DF, disposed to expand and relax in response to pressure oscillations (or more generally, pressure variations) in drilling fluid DF, thereby absorbing (attenuating) the corresponding effect of the oscillations (or variations) in the oil in oil space 310. As a result, the pressure oscillations (or variations) tend not to be transferred into the oil.

FIG. 4A also depicts upper hub 113 connected to upper housing 111. An uphole (upper) end of datalink shaft 115 is received into upper hub 113. Spring 114 is also shown on FIG. 4A, and is described in more detail below with reference to FIG. 4B.

FIG. 4B is an enlargement of a corresponding region shown on FIG. 4. FIG. 4B is a partial section, partial cutaway view of an embodiment of an anti-rotation assembly and an embodiment of a movable piston assembly deployed on the illustrated embodiment of the datalink tool. FIG. 4B shows datalink shaft 115 connected to piston 116, and piston 116 in turn connected to piston cap 117. It will be seen from FIG. 2 that datalink shaft 115, piston 116 and piston cap 117 are part of LWD-connected assembly 100. FIG. 4B further shows shaft sleeve 214 connected to lower housing 209. It will be seen from FIG. 2 that shaft sleeve 214 and lower housing 209 are part of MWD-connected assembly 200. FIG. 4B illustrates the connected assembly of datalink shaft 115, piston 116 and piston cap 117 received inside the connected assembly of shaft sleeve 214 and lower housing 209. FIGS. 2 and 4B thus combine to show that datalink shaft 115, piston 116, piston cap 117, shaft sleeve 214 and lower housing 209 are at the longitudinal interface between LWD-connected (fixed) assembly 100 and MWD-connected (oscillating) assembly 200.

As noted, FIG. 4B illustrates an anti-rotation assembly. The anti-rotation assembly is configured to prevent differential rotation about a longitudinal axis between LWD-connected assembly 100 and MWD-connected assembly 200. It is preferable to avoid such differential rotation to prevent data-communicating wires electrically connected within LWD-connected assembly 100 and MWD-connected assembly 200 from twisting and becoming tangled. FIGS. 4B and 4D should be viewed together to understand the anti-rotation assembly. FIG. 4D is a section as shown on FIG. 4B. FIG. 4B illustrates slots 118 provided in datalink shaft 115. Looking now at FIGS. 4B and 4D together, anti-rotation keys 216 are received in anti-rotation key receptacles 215 in shaft sleeve 214. Key retainer 217 is received over shaft sleeve 214 to retain anti-rotation keys 216 within their corresponding anti-rotation key receptacles 215. As shown on FIG. 4D, anti-rotation keys 216 protrude through shaft sleeve 214 to be received in and to engage with slots 118 in datalink shaft 115. The engagement of anti-rotation keys 216 within slots 118 prevents differential rotation about a longitudinal axis between datalink shaft 115 and shaft sleeve 214, thereby preventing differential rotation between LWD-connected assembly 100 (as shown on FIG. 2) and MWD-connected assembly 200 (as shown on FIG. 2).

FIG. 4B further depicts oil reservoir 300, which is discussed in more detail below with reference to FIG. 4C. It will be understood from FIGS. 4A and 4B, however, that oil reservoir 300 on FIG. 4B is in oil communication with oil spaces 310 on FIG. 4A via through-bore oil pathways provided in piston cap 117, piston 116 and datalink shaft 115 for the purpose.

FIG. 4B also illustrates a movable piston assembly. As noted above and with further reference to FIG. 2, datalink shaft 115, piston 116, piston cap 117, shaft sleeve 214 and lower housing 209 on FIG. 4B are at the longitudinal interface between LWD-connected (fixed) assembly 100 and MWD-connected (oscillating) assembly 200. The movable piston assembly illustrated on FIG. 4B accommodates relative oscillating displacement between LWD-connected (fixed) assembly 100 and MWD-connected (oscillating) assembly 200. FIG. 4B illustrates that relative longitudinal (sliding) displacement is permitted between datalink shaft 115, piston 116 and piston cap 117 (fixed), on the one hand, and shaft sleeve 214 and lower housing 209 (oscillating) on the other hand. However, the sliding displacement must preferably be pressure-balanced to avoid pressure or vacuum locks. As noted above, oil resides in oil reservoir 300 on FIG. 4B immediately downhole (below) datalink shaft 115/piston 116/piston cap 117, and in a connecting bore through these components. It will further recalled from description of FIG. 2 above that drilling fluid DF is resident in the annular space between drillstring collar 50 (omitted for clarity on FIG. 4B) and the exterior of lower housing 209. FIG. 4B depicts drilling fluid holes 210 provided in lower housing 209 to allow drilling fluid to permeate into the annular space between lower housing 209 and the exterior of datalink shaft 115. Piston 116 and piston cap 117 sealingly isolate oil in oil reservoir 300 from drilling fluid in the annular space between lower housing 209 and datalink shaft 115, while still permitting sliding displacement between datalink shaft 115 and lower housing 209. In this way, pressure balancing between oil and drilling fluid is provided during sliding displacement while preventing the drilling fluid from contaminating the oil in oil reservoir 300.

FIG. 4B further depicts shaft sleeve 213 preferably provided at the seal interface between lower housing 209 and piston 116/piston cap 117. In some embodiments, shaft sleeve 213 may be a replaceable item providing an excellent sliding seal contact with piston 116/piston cap 117 via high tolerance machining, for example. In this way, sliding seal contact can be enhanced locally at the seal interface between lower housing 209 and piston 116/piston cap 117 using replaceable, lower-cost components within the larger, more expensive lower housing 209. In such embodiments on FIG. 4B, spacer 211 and o-ring 212 may further assist deployment of shaft sleeve 213 within lower housing 209.

FIG. 4B also depicts spring 114. As noted above with reference to FIG. 2, spring 114 is not, in currently preferred deployments, part of the embodiments of the above-described compensator assembly (refer above to FIG. 4A and associated discussion of compensator assembly). Referring now to FIGS. 2 and 3, spring 114 biases LWD-connected assembly 100 to separate longitudinally away from MWD-connected assembly 200 in a rest condition. Referring specifically to FIG. 3, the rest condition bias from spring 114 thereby maintains a longitudinal force resistance behind rotatable connectors 101, 201. This force resistance assists threaded connection of rotatable connectors 101, 201 to uphole components and downhole components, respectively, during the pre-drilling BHA assembly process.

FIG. 4C is an enlargement of a corresponding region shown on FIG. 4. FIG. 4C illustrates features and components provided on embodiments of the disclosed datalink technology for filling oil reservoir 300 (and oil spaces 310 as described above with reference to FIG. 4A) with non-conductive oil. It will be understood that the disclosed datalink tool optimally receives oil while being assembled prior to being placed in downhole service.

FIG. 4C shows lower housing 209 connected to lower mandrel 204, which in turn is connected to lower centralizer and sleeve 203/203A. FIG. 4C further shows oil fill tube 207 received into lower mandrel 204, and lower high-pressure feed through connector 205 received into an uphole end of oil fill tube 207. Feed through cap 208 secures lower high-pressure feed through connector 205 into the uphole end of oil fill tube 207.

FIG. 4C further illustrates that an annular space forms between oil fill tube 207 and lower mandrel 204 when oil fill tube 207 is received into lower mandrel 204. Lower mandrel 204 provides oil port 206, through which oil may be introduced into the annular space between oil fill tube 207 and lower mandrel 204. Oil port plug and washer 218 secure oil port 206 when not in use. It will be further appreciated that in the illustrated embodiment of FIG. 4C, oil must be introduced through oil port 206 before lower mandrel 204 is connected to lower centralizer and sleeve 203/203A.

Figure 4E:
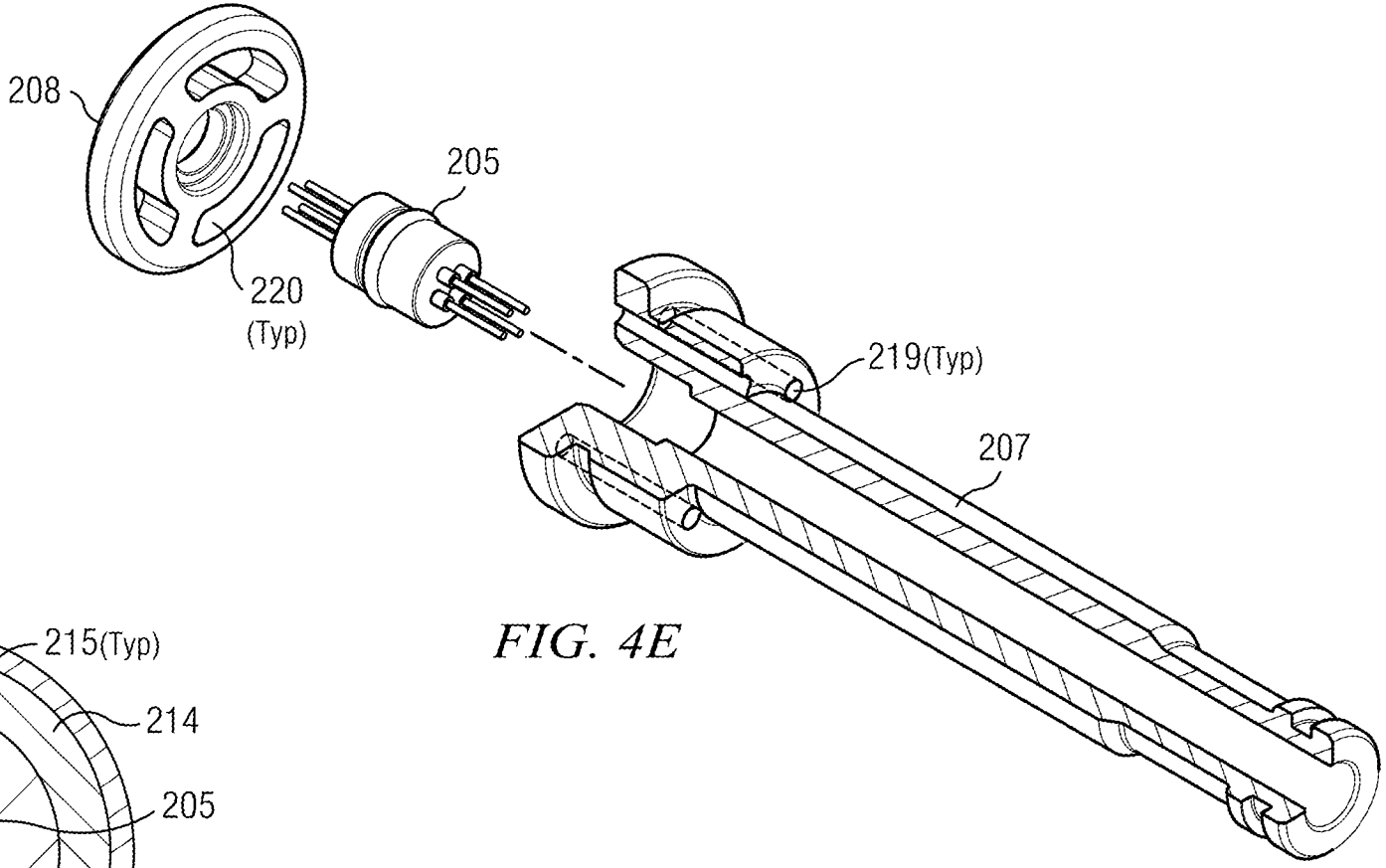
FIG. 4E illustrates features of oil fill tube 207, high-pressure feed through connector 205 and feed through cap 208 from FIG. 4C in isolation.
Figure 4D:
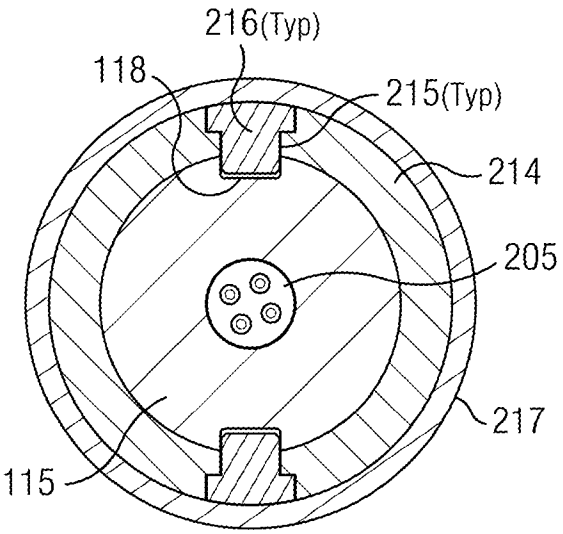
FIG. 4D is a section as shown on FIG. 4B.

FIG. 4E illustrates features of oil fill tube 207, high-pressure feed through connector 205 and feed through cap 208 from FIG. 4C in isolation. Referring now to FIGS. 4C and 4E together, it will be seen that oil fill tube 207 provides oil fill tube holes 219 and feed through cap 208 provides feed through cap apertures 220. FIG. 4C shows that when the illustrated components are fully assembled, oil fill tube holes 219 and feed through cap apertures 220 fluidly connect the annular space between oil fill tube 207 and lower mandrel 204 to oil reservoir 300. It will be thus appreciated from FIG. 4C that oil may be introduced through oil port 206 to fill oil reservoir 300 (and oil spaces 310 described above with reference to FIG. 4A).

Figure 5:
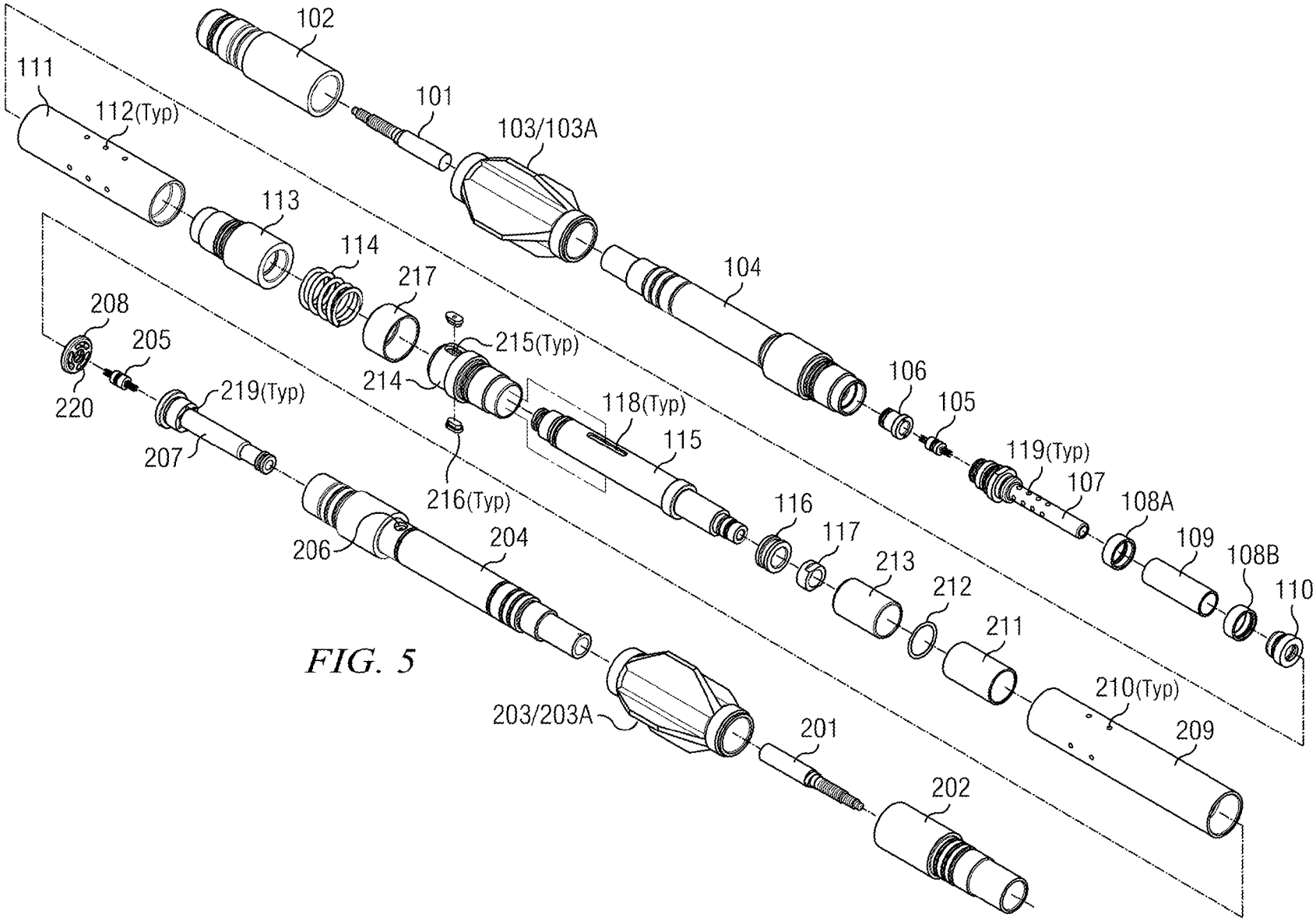
FIG. 5 is an exploded view of the embodiments of an oscillating datalink tool shown on FIGS. 2 through 4E.

FIG. 5 is an exploded view of the embodiments of an oscillating datalink tool shown on FIGS. 2 through 4E. FIG. 5 depicts the following components in isolation:

| | |
|---|---|
| Rotatable connector | 101 |
| Upper end cap | 102 |
| Upper centralizer and upper centralizer sleeve | 103/103A |
| Upper mandrel | 104 |
| High pressure feed through (electrical connector) | 105 |
| Feed through mount | 106 |
| Compensator tube | 107 |
| Sealing ring | 108A/108B |
| Compensator sleeve | 109 |
| Compensator cap | 110 |
| Upper housing | 111 |
| Drilling fluid holes | 112 |
| Upper hub | 113 |
| Spring | 114 |
| Datalink Shaft | 115 |
| Piston | 116 |
| Piston cap | 117 |
| Slots | 118 |
| Compensator tube oil holes | 119 |
| Rotatable connector | 201 |
| Lower end cap | 202 |
| Lower centralizer and lower centralizer sleeve | 203/203A |
| Lower mandrel | 204 |
| High pressure feed through (electrical connector) | 205 |
| Oil port | 206 |
| Oil fill tube | 207 |
| Feed through cap | 208 |
| Lower housing | 209 |
| Drilling fluid holes | 210 |
| Spacer | 211 |
| O-ring | 212 |
| Piston sleeve | 213 |
| Shaft sleeve | 214 |
| Receptacles for anti-rotation keys | 215 |
| Anti-rotation keys | 216 |
| Anti-rotation key retainer | 217 |
| Oil port plug and washer | 218 |
| Oil fill tube holes | 219 |
| Feed through cap apertures | 220 |

It will be understood that throughout the foregoing description, conventional components such as threaded connections and seals (e.g. o-rings and other types of conventional seals) are either omitted or not discussed for clarity. Persons of ordinary skill will understand this disclosure without the need for reference to these conventional components.

Variations. Alternative embodiments of the disclosed oscillating datalink technology could be used in conjunction with various MWD systems deployed on a BHA. As noted, some datalink tool embodiments described and illustrated in this disclosure are preferably characterized for use in conjunction with Gordon Technologies' Shock Miser® tool deployed on the UBHO/pulser. See U.S. Pat. No. 9,644,434. Other embodiments could be characterized for use in conjunctions with, for example, vibration dampeners such as the Axial Isolator tool available from Lord corporation.

The embodiments of a hardwired oscillating datalink tool disclosed herein have been described herein primarily to enable an LWD-MWD datalink between MWD/pulser equipment and LWD equipment located uphole of the MWD/pulser equipment. Alternative embodiments of the disclosed hardwired oscillating datalink technology could be also used to provide a hardwired datalink between MWD/pulser equipment and LWD equipment located downhole of the MWD/pulser equipment if the BHA configuration permitted such a hardwired datalink.

Although the inventive material in this disclosure has been described in detail along with some of its technical advantages, it will be understood that various changes, substitutions and alternations may be made to the detailed embodiments without departing from the broader spirit and scope of such inventive material, some embodiments of which are recited in the appended claims.

We claim:

1. A datalink tool, comprising:

a first assembly and a second assembly, wherein the second assembly is disposed to move relative to the first assembly;

a space;

a hardwired electrical connection between the first and second assemblies, such that at least part of the hardwired electrical connection is configured to be immersed in an internal fluid contained inside the space; and a compensator sleeve contributing at least in part to isolation of the internal fluid inside the space from an external fluid residing outside the space;

wherein the compensator sleeve is disposed to expand and relax in response to pressure variations in the external fluid, such that said expansion and relaxation of the compensator sleeve attenuates transfer of said external fluid pressure variations into the internal fluid.

2. The datalink tool of claim 1, in which the datalink tool is deployed inside a drillstring collar.

3. The datalink tool of claim 1, in which the first assembly is an LWD-connected assembly.

4. The datalink tool of claim 1, in which the second assembly is an MWD-connected assembly.

5. The datalink tool of claim 4, in which the datalink tool is deployed in a subterranean drillstring including a bit, and in which the MWD-connected assembly is located nearer the bit than the datalink tool.

6. The datalink tool of claim 1, in which the external fluid is conductive.

7. The datalink tool of claim 1, in which the datalink tool is deployed in a subterranean drillstring, and in which the external fluid is drilling fluid.

8. The datalink tool of claim 1, in which the datalink tool is deployed in a subterranean drillstring, and in which the internal fluid is nonconductive oil.

9. The datalink tool of claim 1, in which the datalink tool is deployed in a subterranean drillstring, and in which the hardwired connection does not cross a UBHO sub.

10. The datalink tool of claim 1, in which the compensator sleeve is made from a material selected from a group consisting of:

(a) polymer; and (b) metal.

11. The datalink tool of claim 1, further including a movable piston assembly disposed to accommodate relative movement between the first assembly and the second assembly.

12. A datalink tool, comprising:

a first assembly and a second assembly, wherein the second assembly is disposed to move relative to the first assembly;

a space;

a hardwired electrical connection between the first and second assemblies, such that at least part of the hardwired electrical connection is configured to be immersed in a nonconductive fluid contained inside the space; and a compensator sleeve contributing at least in part to isolation of the nonconductive fluid inside the space from a conductive fluid residing outside the space;

wherein the compensator sleeve is disposed to expand and relax in response to pressure variations in the conductive fluid, such that said expansion and relaxation of the compensator sleeve attenuates transfer of said conductive fluid pressure variations into the nonconductive fluid.

13. The datalink tool of claim 12, in which the datalink tool is deployed inside a drillstring collar.

14. The datalink tool of claim 12, in which the first assembly is an LWD-connected assembly.

15. The datalink tool of claim 12, in which the second assembly is an MWD-connected assembly.

16. The datalink tool of claim 15, in which the datalink tool is deployed in a subterranean drillstring including a bit, and in which the MWD-connected assembly is located nearer the bit than the datalink tool.

17. The datalink tool of claim 12, in which the datalink tool is deployed in a subterranean drillstring, and in which the nonconductive fluid is oil and the conductive fluid is drilling fluid.

18. The datalink tool of claim 12, in which the datalink tool is deployed in a subterranean drillstring, and in which the hardwired connection does not cross a UBHO sub.

19. The datalink tool of claim 12, further including a movable piston assembly disposed to accommodate relative movement between the first assembly and the second assembly.

20. A datalink tool, comprising:

a first assembly and a second assembly, wherein the second assembly is disposed to move relative to the first assembly;

a space;

a hardwired electrical connection between the first and second assemblies, such that at least part of the hardwired electrical connection is configured to be immersed in a nonconductive oil contained inside the space; and a compensator sleeve contributing at least in part to isolation of the nonconductive oil inside the space from an external fluid residing outside the space;

wherein the compensator sleeve is disposed to expand and relax in response to pressure variations in the external fluid, such that said expansion and relaxation of the compensator sleeve attenuates transfer of said external fluid pressure variations into the nonconductive oil.

* * * * *